US005941636A

United States Patent [19]

Lu

[11] Patent Number: 5,941,636

[45] Date of Patent: Aug. 24, 1999

[54] MIXER HAVING MIXING BLADES CAPABLE OF EXPANDING AUTOMATICALLY

[76] Inventor: Chen-Yi Lu, No. 22, Shu-Yi 1st Ln. Sec. 1 Fu-Hsing Rd., Taichung, Taiwan

[21] Appl. No.: 09/044,967

[22] Filed: Mar. 19, 1998

[51] Int. Cl.[6] ..... B01F 7/20

[52] U.S. Cl. ..... 366/249; 366/308

[58] Field of Search ..... 366/242–252, 366/262–265, 270, 308, 331; 416/142, 143

[56] References Cited

U.S. PATENT DOCUMENTS 1,218,623 3/1917 Brillhart ..... 366/308
3,132,850 5/1964 Puchalski ..... 366/308
4,981,367 1/1991 Brazleton ..... 366/308
5,489,151 2/1996 Weber ..... 366/247

*Primary Examiner*—Charles E. Cooley
*Attorney, Agent, or Firm*—W. Wayne Liauh

[57] ABSTRACT

A mixer is composed of a base, a drive shaft, a plurality of blade seats and mixing blades. The base is engaged with the opening of a liquid container and fastened with a circular body which is fitted over the drive shaft such that the drive shaft is slanted in the liquid container. The blade seats are fastened at an interval with the drive shaft and provided with a pivoting slot in which the mixing blade is fastened pivotally. As the drive shaft is driven by a power source to revolve, the mixing blades are caused to expand by the centrifugal force so as to bring about the mixing effect.

5 Claims, 6 Drawing Sheets

MIXER HAVING MIXING BLADES CAPABLE OF EXPANDING AUTOMATICALLY

FIELD OF THE INVENTION

The present invention relates generally to a mixer, and more particularly to the mixing blades of the mixer.

BACKGROUND OF THE INVENTION

As shown in FIGS. 1 and 2, a conventional mixer consists of an oval spherical body 1, a drive shaft 2, a plurality of blade seats 3, and a plurality of blades 33. The short shaft of the oval spherical body 1 has a diameter slightly greater than the diameter of an opening A1 of a container "A". Located along the longitudinal axis of the oval spherical body 1 are a bearing and a hole 11. The drive shaft 2 is fastened pivotally with the bearing via the hole 11 of the oval spherical body 1 such that the drive shaft 2 is connected with a power source "B", and that the drive shaft 2 is fastened at another end thereof with a center holes 31 of the blade seats 3. The blade seats 3 are provided symmetrically in the peripheral surfaces thereof with a plurality of grooves 32. The grooves 32 have a center line forming an angle θ with the center line of the blade seats 3. The blades 33 are fastened pivotally with the grooves 32 of the blade seats 3 by means of pivots 34 such that the blades 33 are capable of turning unidirectionally and in the same direction at an angle of 90 degrees. The oval spherical body 1 has a longitudinal end which is extended out of the bottom end of the drive shaft 2. Another longitudinal end of the oval spherical body 1 has an arcuate surface 12 which is located on the opening A1 of the container "A". As the drive shaft 2 is driven, the blades 33 are caused to expand by the centrifugal force such that the blades 33 are perpendicular to the center lines of the blade seats 3, so as to bring about the action of mixing the liquid held in the container "A". The arcuate surface 12 of the oval spherical body 1 is capable of making a 360-degree rotation along the opening A1 so as to enable the drive shaft 2 to move around in the container "A".

Such a prior art mixer as described above is defective in design in that the fastening of the blades 33 in the grooves 32 must be precise and that it is technically difficult to fasten pivotally the blades 33 by means of pivots 34 with precision. In addition, the moving range of the drive shaft 2 in the container "A" is limited such that the mixing effect is compromised. When the drive shaft 2 in operation is not stabilized, the expanded blades 33 are prone to hit the inner wall of the container "A". Moreover, the mixing effect of the prior art mixer is undermined when the rotational speed of the drive shaft 2 is too slow to cause the blades 33 to expand fully.

SUMMARY OF THE INVENTION

The primary objective of the present invention is to provide an improved mixer free from the drawbacks of the prior art mixer described above.

In keeping with the principle of the present invention, the foregoing objective of the present invention is attained by a mixer consisting of mixing blades capable of expanding automatically so as to bring about a thorough mixing action. The blades are fastened pivotally with a plurality of blade seats which are in turn fastened with a drive shaft. The drive shaft is provided at the top end thereof with a stepped circular body which has a stepped surface capable of causing the drive shaft to slant when the stepped surface of the stepped circular body is stopped by an inclined surface of a base which is fastened with the opening of a container in which the liquid to be mixed is held.

The foregoing objective, features and functions of the present invention will be more readily understood upon a thoughtful deliberation of the following detailed description of a preferred embodiment of the present invention with reference to the accompanying drawings.

DETAILED DESCRIPTION OF THE EMBODIMENT

Figure 1:
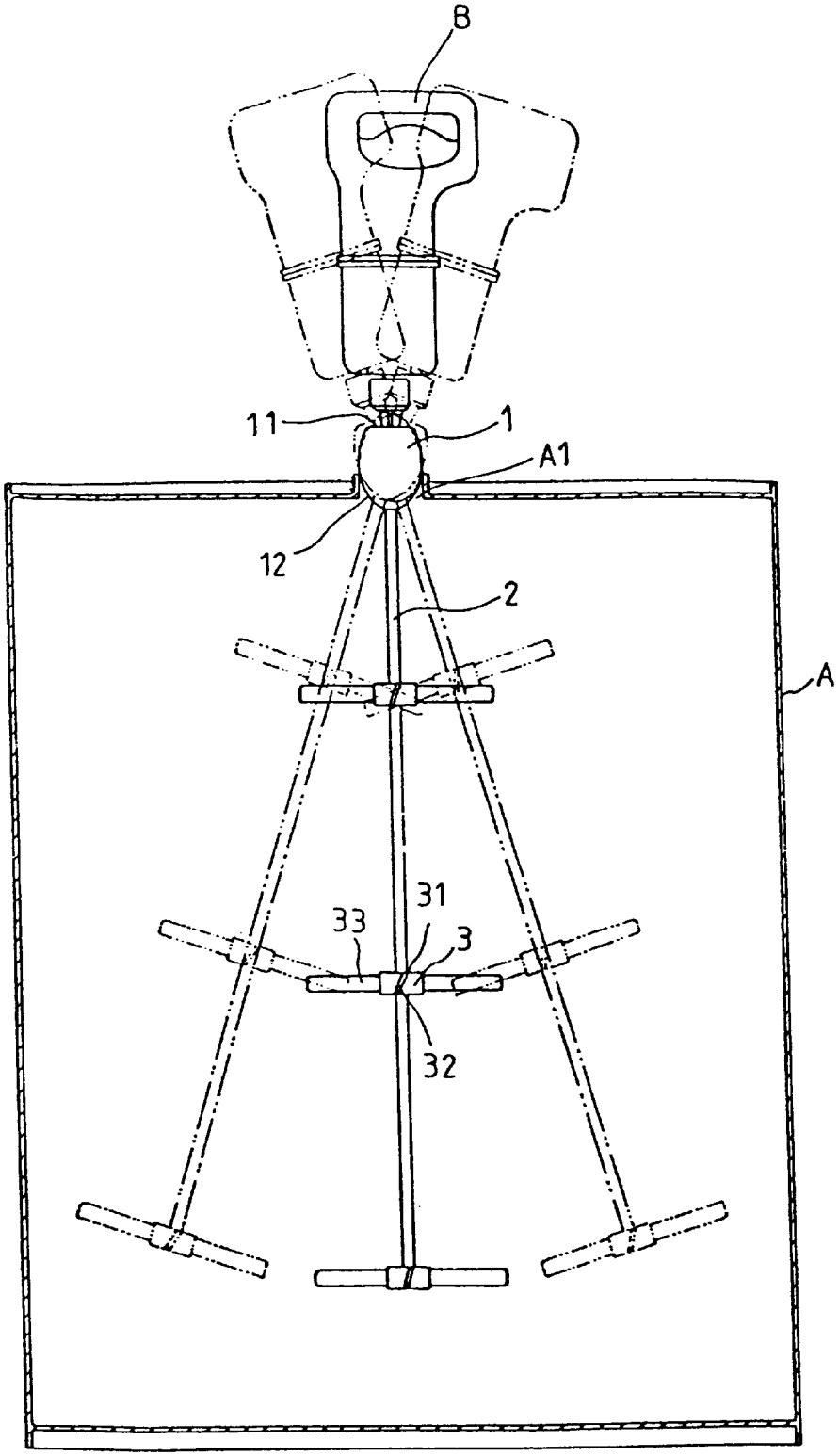
Fig·1 PRIOR ART
FIG. 1 shows a schematic view of a prior art mixer at work.
Figure 2:
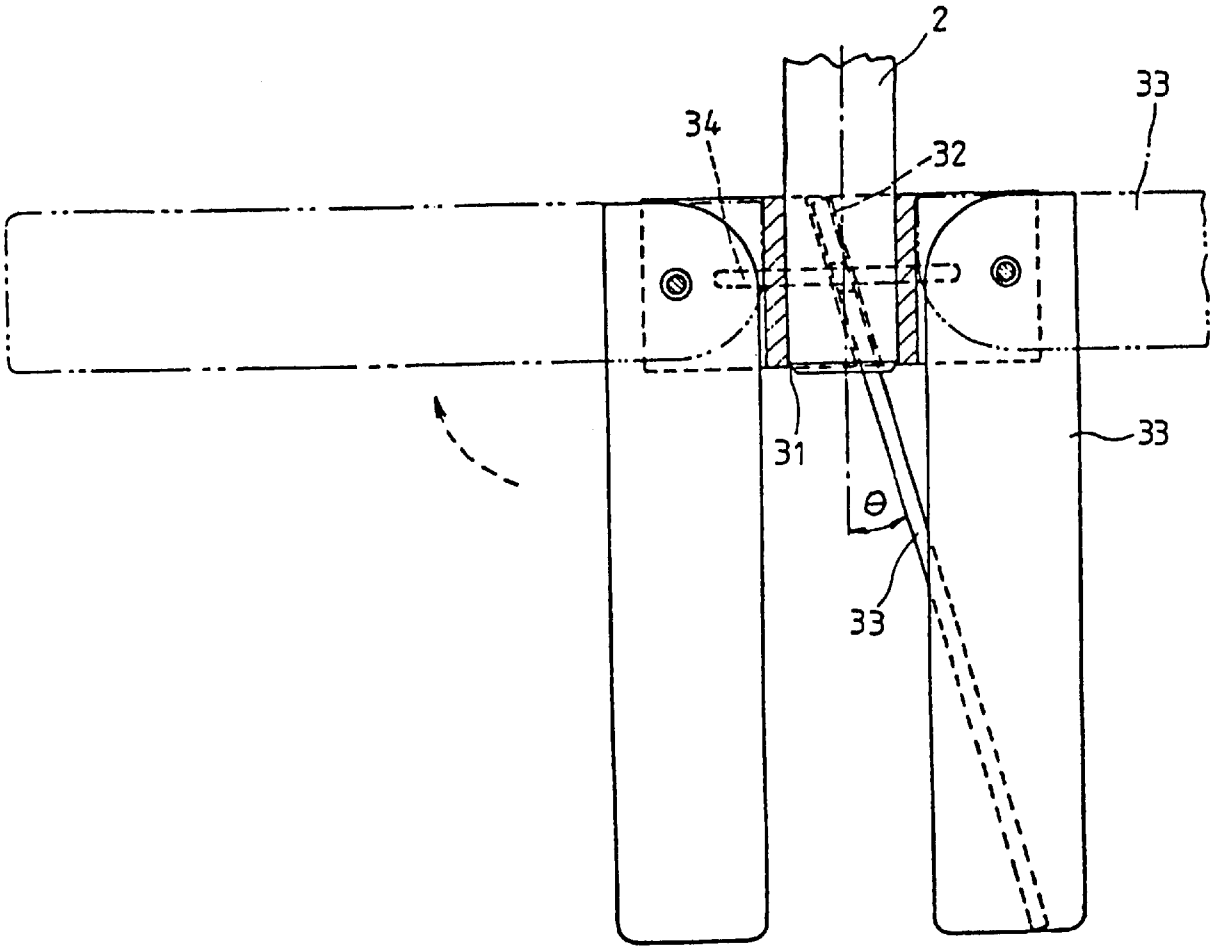
Fig. 2 PRIOR ART
FIG. 2 shows a partial sectional view of the prior art mixer.
Figure 3:
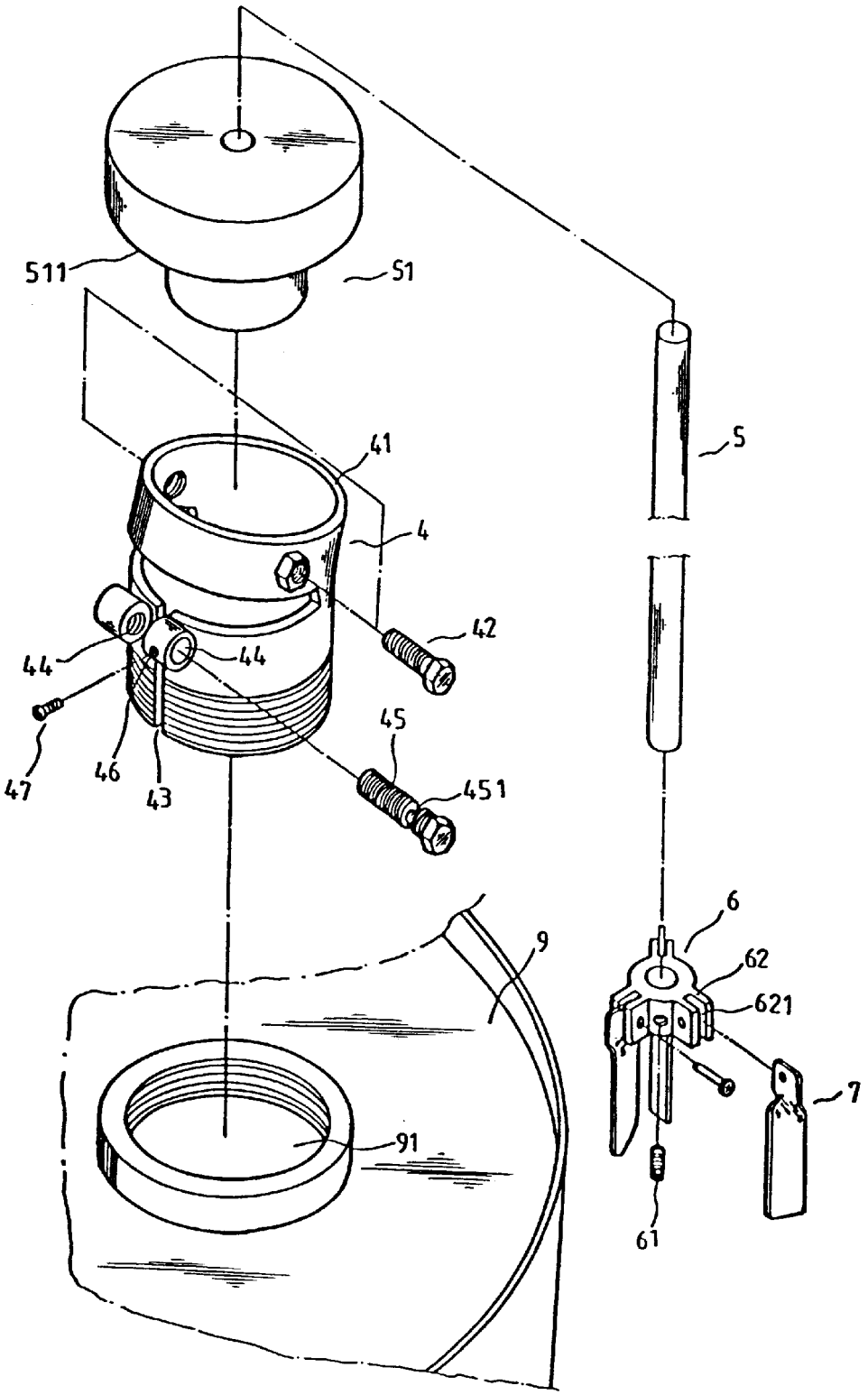
FIG. 3 shows an exploded view of a mixer embodied in the present invention.

As shown in FIG. 3, a mixer embodied in the present invention is composed of a base 4, a drive shaft 5, and a plurality of blade seats 6 and blades 7.

The base 4 is of a hollow construction and is provided in the top thereof with an inclined surface 41 and in the wall of the top portion thereof with a tightening bolt 42. The base 4 is further provided in the bottom portion thereof with a cut 43, two threaded holes 44 located at both sides of the cut 43, and a fastening bolt 45 which is engaged with the threaded holes 44. One of the two threaded holes 44 is provided in the wall thereof with a stopping threaded hole 46. The fastening bolt 45 has a stopping portion 451. A bolt 47 is engaged with the stopping threaded hole 46 such that one end of the bolt 47 is engaged with the stopping portion 451 of the fastening bolt 45.

The drive shaft 5 is driven by a power source 8 and is put through a stepped circular body 51 which has a stepped portion 511 and a bearing 52.

The blade seats 6 are fitted respectively over the drive shaft 5 such that the blade seats 6 are located respectively with a locating bolt 61. The blade seats 6 are provided in the outer wall thereof with a plurality of lugs 62 each having a pivoting slot 621.

The blades 7 are fastened pivotally at one end thereof with the pivoting slot 621 such that the blades 7 are capable of expanding at the time when the drive shaft 5 is in motion.

Figure 4:
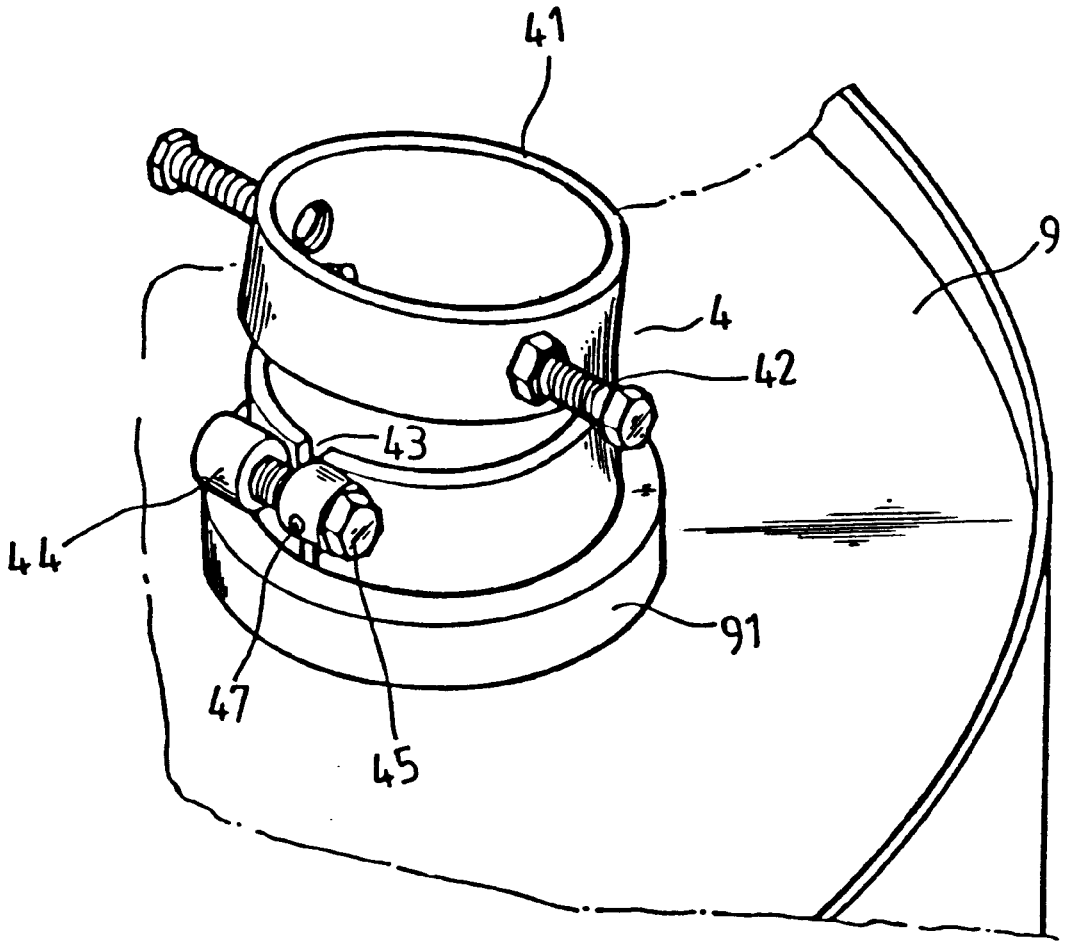
FIG. 4 shows a partial schematic view of the mixer of the present invention.
Figure 5:
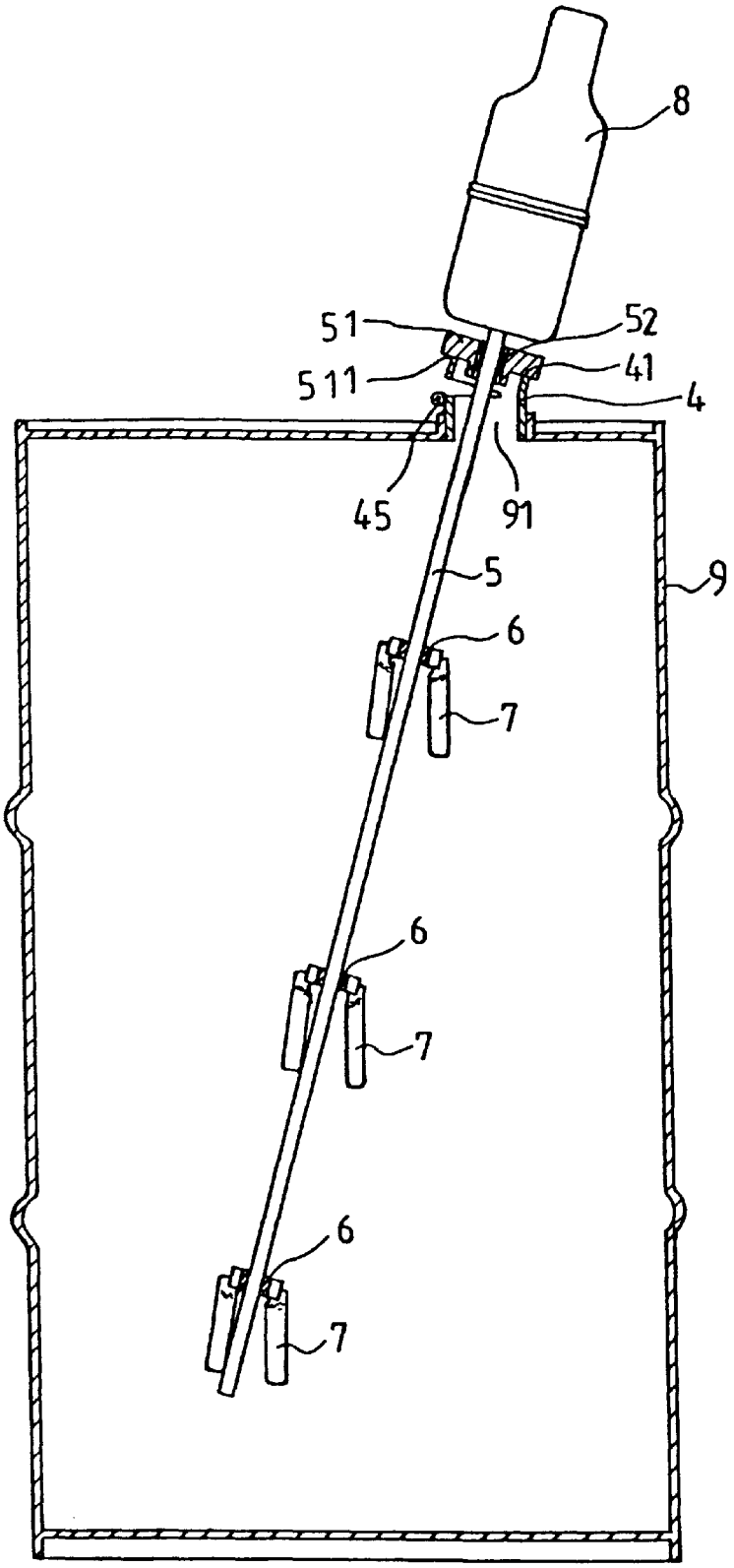
FIG. 5 shows a schematic view of the present invention in conjunction with a container holding the liquid to be mixed.
Figure 6:
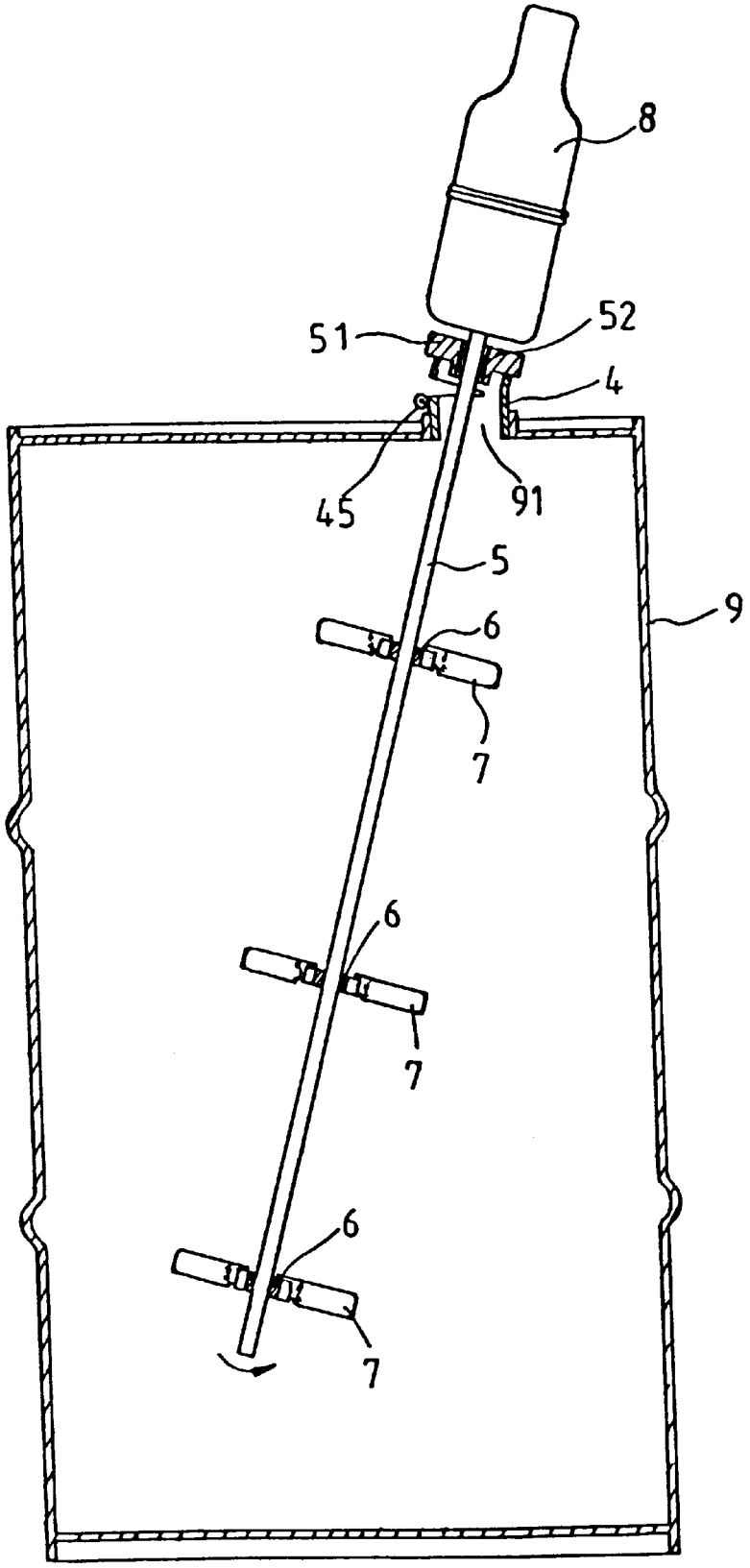
FIG. 6 shows a schematic view of the present invention at work.

As shown in FIGS. 4 and 5, the base 4 is fastened at the opening 91 of a container 9 in which the liquid is held. The fastening bolt 45 is loosened, whereas the bolt 47 is engaged with the stopping threaded hole 46 such that the bolt 47 is engaged with the stopping portion 451 of the fastening bolt 45, so as to enable the bottom end of the base 4 to expand to press against the inner wall of the opening 91 of the container 9. In the meantime, the tightening bolt 42 engages the stepped circular body 51 to secure the stepped circular body 51 within the base 4. The stepped portion 511 of the stepped circular body 51 is slanted by the inclined surface 41 of the base 4, thereby causing the drive shaft 5 to remain in a slanting position inside the container 9, as shown in FIG. 5.

In operation, the base 4 does not rotate in light of the stepped circular body 51 which is provided therein with the bearing 52. The mixing blades 7 are caused to expand by the centrifugal force of the drive shaft 5 in motion such that the blades 7 are perpendicular to the blade seats 6, and that the top end of the blades 7 is stopped by the inner wall of the pivoting slot 621. The mixing effect is thus brought about by the rotational force of the blades 7 in motion. The liquid held in the container 9 is therefore mixed thoroughly by the mixer of the present invention.

What is claimed is:

1. A mixer comprising:

a base of a hollow construction and engageable with the opening of a liquid container, said base provided in a top thereof with an inclined surface;

a drive shaft fastened at one end thereof with a power source and provided with a stepped circular body fitted thereover, said stepped circular body provided therein with a bearing in which said drive shaft revolves without causing said base to rotate at the time when said drive shaft is driven by the power source to revolve, said stepped circular body having a stepped portion in contact with said inclined surface of said base such that said drive shaft is slanted;

a plurality of blade seats fastened at an interval with said drive shaft and provided with a plurality of lugs each having a pivoting slot; and a plurality of blades each being fastened pivotally in said pivoting slot of said blade seat such that said blade is capable of being expanded by a centrifugal force of said drive shaft in motion.

2. The mixer as defined in claim 1, wherein said blade seats are fastened respectively with said drive shaft by a fastening bolt.

3. The mixer as defined in claim 1, wherein said base is provided with a bolt for tightening and fastening said stepped circular body.

4. The mixer as defined in claim 1, wherein said base is provided with a cut and two threaded holes engaged with a bolt for tightening said base to enable said base to fit into the opening of the liquid container.

5. The mixer as defined in claim 4, wherein one of said two threaded holes is provided with a stopping threaded hole which is engaged with a fastening bolt for fastening said bolt.

* * * * *